US006189815B1

(12) United States Patent
Potschin et al.

(10) Patent No.: US 6,189,815 B1
(45) Date of Patent: Feb. 20, 2001

(54) VALVE CONTROL UNIT FOR A FUEL INJECTION VALVE

(75) Inventors: Roger Potschin, Brackenheim; Friedrich Boecking, Stuttgart, both of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/330,994

(22) Filed: Jun. 14, 1999

(30) Foreign Application Priority Data

Jun. 16, 1998 (DE) ..... 198 26 794

(51) Int. Cl.[7] ..... F02M 59/00; B05B 1/30
(52) U.S. Cl. ..... 239/533.2; 239/572; 239/584
(58) Field of Search ..... 239/533.1, 533.2, 239/533.3, 569, 570, 571, 572, 5, 86, 96, 584; 251/30.01, 30.02, 129.14

(56) References Cited

U.S. PATENT DOCUMENTS 1,802,933 * 4/1931 Von Salis ..... 239/533.1
4,463,901 * 8/1984 Perr et al. ..... 239/95
5,542,610 * 8/1996 Augustin ..... 239/533.8
5,806,766 * 9/1998 Krueger et al. ..... 239/96
5,890,653 * 4/1999 Kelly ..... 239/5

* cited by examiner

*Primary Examiner*—Andres Kashnikow
*Assistant Examiner*—Jorge Bocanegra
(74) *Attorney, Agent, or Firm*—Ronald E. Greigg; Edwin E. Greigg

(57) ABSTRACT

A valve control unit for a fuel injection valve, has a housing body, in which two valve control chambers that communicate continuously with one another are provided. The first valve control chamber communicates fuel with an inflow conduit for fuel pressure on a terminal member of a valve control piston which is displaceable in the housing body and the second valve control chamber communicates with a closable outlet conduit. A mechanical stop for limiting the mobility of the valve control piston in the direction of the second valve control chamber is embodied on the housing body. The quantity of preinjected fuel can be minimized by the volume of fuel in the first valve control chamber.

5 Claims, 2 Drawing Sheets

VALVE CONTROL UNIT FOR A FUEL INJECTION VALVE

BACKGROUND OF THE INVENTION

The invention is based on a valve control unit for a fuel injection valve, in particular for a common rail injector.

A valve control unit of this kind for a fuel injection valve is known for instance from European Patent Disclosure EP 0 661 442 A1.

In the known valve control unit, there are two valve control chambers communicating continuously with one another in the housing body. The first valve control chamber communicates with an inflow conduit for fuel, which is connected to a high-pressure reservoir (common rail). The second valve control chamber has a passage to an outlet conduit, which can be opened and closed via a magnet valve. When the valve control unit is triggered, the outlet conduit is opened. As a result, the pressure in the second valve control chamber and thus in the first valve control chamber as well drops, so that the hydraulic imposition of pressure on one end of the valve control piston is also reduced. The other end of the valve control piston is connected to a nozzle needle for performing the injection. As soon as the hydraulic pressure imposition drops below the pressure imposition of the nozzle needle, the nozzle needle opens, so that the fuel can emerge through the injection opening into a combustion chamber. Manipulating the pressure ratios of the valve control chambers is done so as to control the valve control piston.

The terminal member of the valve control piston can be displaced in the injection event inside the first valve control chamber as far as a hydraulic stop (fuel cushion), which forms in the passage region between the first and second valve control chambers. This hydraulic stop is determined essentially by the size of the volume of the first valve control chamber. The known valve control unit has a first valve control chamber with a small volume, since only a small volume of the first valve control chamber assures that the hydraulic stop will not cause any vibration of the valve control piston and will have adequate rigidity. Because of the volumetric proportions of the first and second valve control chamber to one another, however, a considerable pressure gradient develops between the first and second valve control chambers. In the preinjection, the valve control piston can consequently move with a long valve stroke, so that a larger quantity of fuel is injected into the combustion chamber in the preinjection.

It would also be desirable to reduce the outer diameter of the terminal member of the valve control piston, so that this terminal member would have a lesser positive displacement cross section for fuel from the first valve control chamber. Reducing the outer diameter, however, necessarily increases the free volume of the valve control chamber, so that designing first valve control chamber in this way in turn leads to increased vibration on the part of the valve control piston at the hydraulic stop. Disadvantageously, the outer diameter of the terminal member of the valve control piston can therefore not be reduced, even though such a reduction, because of its reduced positive displacement cross section, would make an increased speed of motion of the terminal member possible.

OBJECT AND SUMMARY OF THE INVENTION

To minimize the preinjection quantity of fuel, the valve control unit for a fuel injection valve according to the invention has a mechanical stop for limiting the mobility of the valve control piston in a direction of a second valve control chamber.

The motion of the valve control piston is limited by a mechanical stop, which is embodied inside the housing body of the valve control unit. This mechanical stop can be embodied in various ways. In a simple variant of the invention, the valve control piston can change over in steps from a larger to a smaller outer diameter, and a counterpart step complementary to this step can be present on the housing body. To uncover the injection opening, the valve control piston can be moved with a stroke which is determined by the spacing of the two steps, when the injection opening is closed and the terminal member of the valve control piston is impinged by pressure.

Because of the embodiment of the mechanical stop, the hydraulic stop can be dispensed with, so that the first valve control chamber can be embodied with a larger volume. The first valve control chamber can advantageously have a volume of up to 60 $mm^3$, while it is still assured then that no vibration with regard to the stop of the valve control piston will occur.

If the volume of the second valve control chamber is kept small in comparison with this volume of the first valve control chamber, then the pressure gradient upon opening of the outlet conduit between the first and second valve control chambers is reduced substantially. The resultant shorter stroke of the valve control piston means that initially only a small quantity of fuel is preinjected. The main injection is unaffected.

In the larger volume of the first valve control chamber, a pressure can always be embodied which is essentially equivalent to the pressure inside the high-pressure reservoir (common rail). The pressure ratios inside the first valve control chamber are thus virtually constant both when the fuel injection valve is open and when it is closed. The small volume of the second valve control chamber is pressure-relieved through the opening of the outlet conduit in the injection event. Upon reclosure of the fuel injection valve because of the closure of the outlet conduit by the magnet valve, only the small volume of the second valve control chamber has to be brought to a higher pressure level, and as a result the closing process can be accomplished faster.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
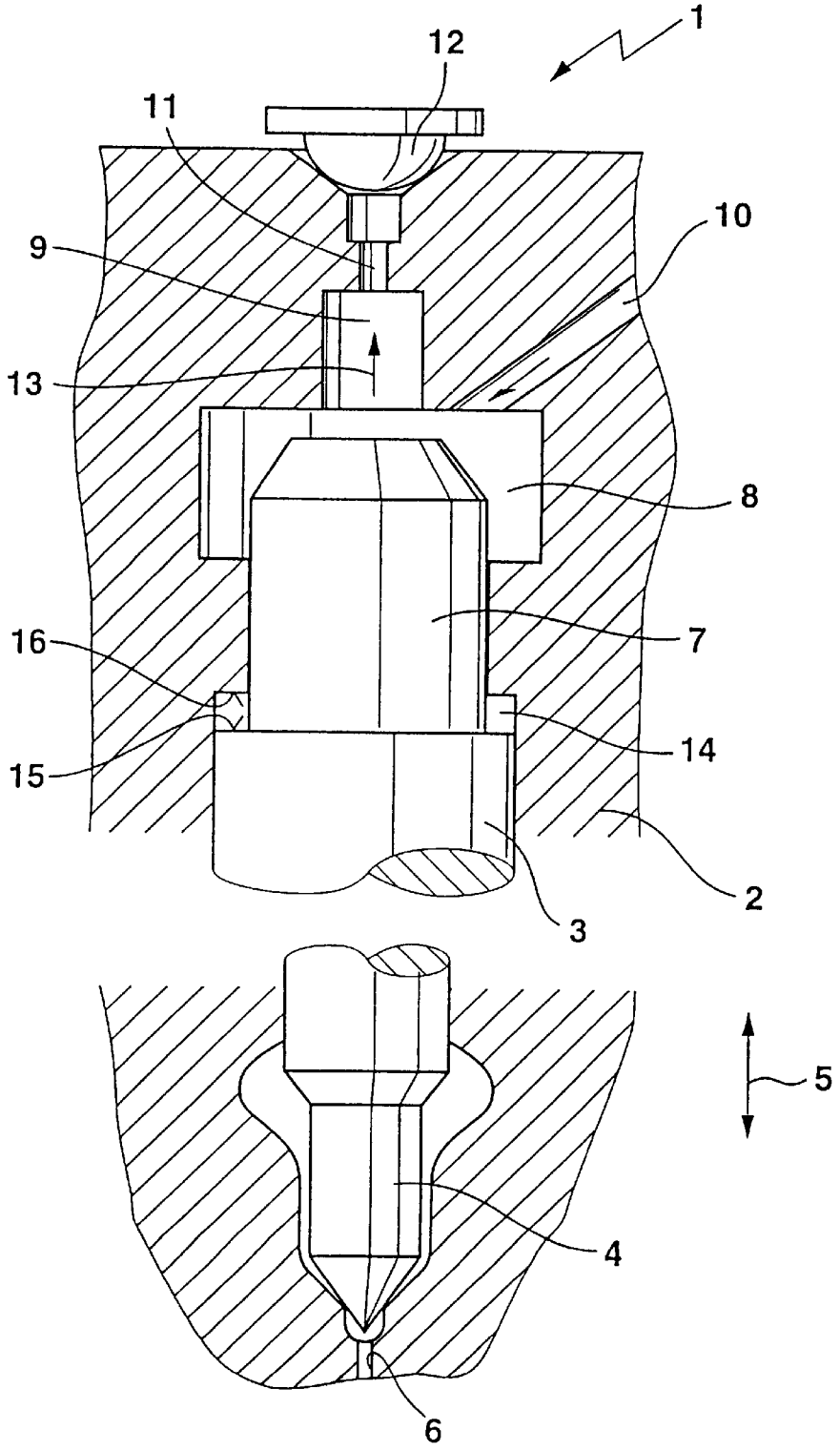
FIG. 1 is a longitudinal section through a valve control unit of an exemplary embodiment, in which a valve control piston has a mechanical stop.

It can be seen from FIG. 1 that a valve control unit 1 has a housing body 2, in which a valve control piston 3 is displaceably supported. The valve control unit 1 is suitable for controlling the fuel injection into a combustion chamber. FIG. 1 shows the state of repose with the injection opening closed. The valve control piston 3 is shown only in part in FIG. 1 and extends as far as a nozzle needle 4. The nozzle needle 4 can be moved in the direction of the arrow 5, so that an injection opening 6 can be uncovered so that the fuel can be injected.

The triggering of the valve control piston 3 is effected via a hydraulic pressure imposition on a terminal member 7 of the valve control piston 3. A first valve control chamber 8 communicates continuously with a second valve control chamber 9. Fuel from a high-pressure reservoir (common rail) can reach the first valve control chamber 8 with the aid of an inflow conduit in the form of an inflow throttle 10. The second valve control chamber 9 is connected to an outlet conduit in the form of an outlet throttle 11. If a valve ball 12 of a magnet valve, not shown in further detail in FIG. 1, opens the outlet conduit, fuel can flow out in the direction of the arrow 13. The change in pressure inside the valve control chamber 8 causes the valve control piston 3 to move inwardly in the direction of the arrow 5. The stroke of the valve control piston 3 is limited, because a mechanical stop is provided on the valve control piston 3, or on the housing body 2. The valve control piston 3 changes over in steps to its terminal member 7. A housing step 14 is also embodied on the housing body 2. Edge faces 15 of the valve control piston 3 can therefore come to rest against counterpart faces 16 of the housing body 2. Because of the embodiment of the mechanical stop, the motion of the terminal member, 7 in the first valve control chamber 8 is limited. The terminal member 7 can move in the direction of the second valve control chamber 9, so that a flow conduit (gap) for fuel from the first valve control chamber 8 into the second valve control chamber 9 becomes smaller in terms of its free flow cross section. Because of the mechanical stop, the volume of the first valve control chamber 8 can be designed to be as great as possible. Compared with the volume of the second valve control chamber 9, the volume of the first valve control chamber 8 is substantially greater. By the design of the volume of the valve control chamber 8, it can be attained that when the outlet conduit 11 opens, only a slow pressure loss occurs in the valve control chamber 8. The terminal member 7 can also be embodied with a reduced outer diameter, so that the free volume, accessible to fuel, in the first valve control chamber 8 is increased still further. Vibration of the valve control piston 3, of the kind that can occur when there is a hydraulic stop and an increased volume of the first valve control chamber 8, is prevented by the mechanical stop.

The outer diameter of the nozzle needle 4 can be reduced while maintaining the same quantity of preinjected fuel as before, for instance to an outer diameter of 3 to 3.7 mm. In that case, the speed of motion of the nozzle needle can be increased (small positive displacement cross section). An increased speed of motion of the nozzle needle can be attained without requiring a larger or faster magnet valve to open or close the outlet conduit. Also because of the increased speed of motion of the nozzle needle, a faster traversal through critical-tolerance stroke regions can become possible.

Figure 2:
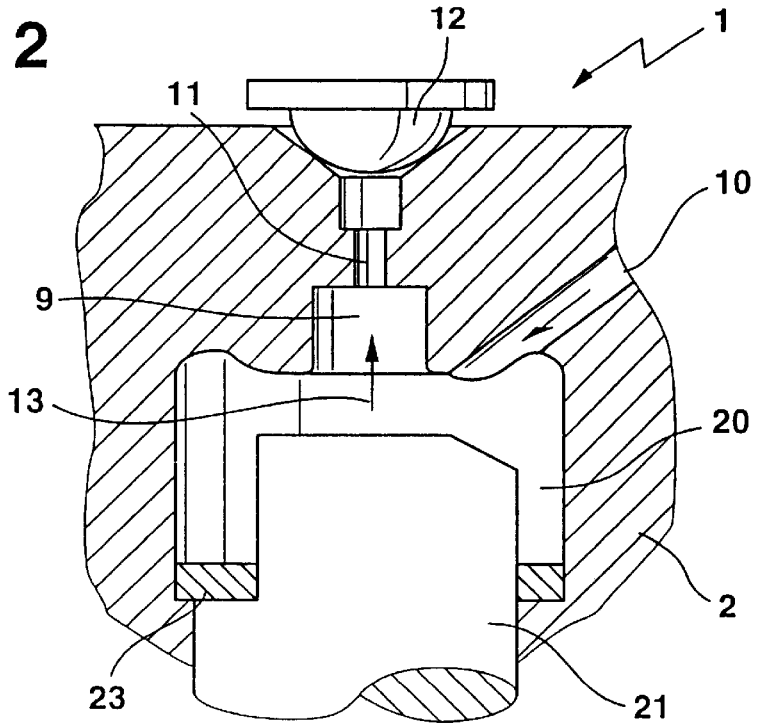
FIG. 2 is a longitudinal section through the valve control unit of FIG. 1, in which the valve control piston is embodied in an alternative way in the region of its terminal member.

FIG. 2 shows a further possible design for a first valve control chamber 20 and a terminal member 21. The other components of FIG. 2 correspond to the components of the valve control unit 1 shown in FIG. 1 and are provided with the same reference numerals. The first valve control chamber 20 has a substantially larger volume than the second valve control chamber 9. A valve control piston, not shown, is connected to the terminal member 21, whose outer diameter is reduced still further to enable moving the terminal member 21 in the first valve control chamber 20 and to displace as little fuel as possible. The volume of the first valve control chamber 20 can additionally be varied by installing an adjusting ring 23, in order to adapt the volume of the first valve control chamber 20 optionally in such a way that vibration of the valve control piston contacting the stop cannot occur.

By means of the volumetric ratios of the first and second valve control chambers 20 and 9, the development of a great pressure gradient upon the opening of the outlet conduit 11 is prevented. This prevents an overly large quantity of fuel from being injected in the preinjection when the valve ball 12 is triggered. The speed of the motion of the valve control piston in the main injection is effected in the way employed in conventional valve control units as well.

Figure 3:
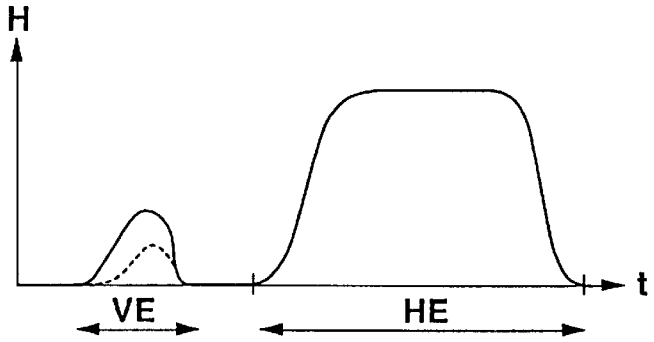
FIG. 3 is a schematic graph of the piston stroke as a function of time after opening of the outlet conduit, for differently embodied volumes of the first valve control chamber.
Figure 4:
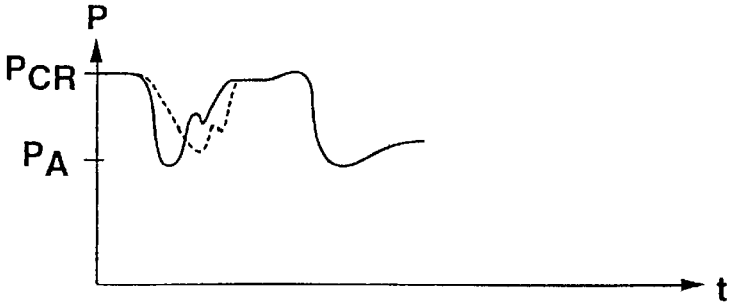
FIG. 4 is a schematic graph showing the dependence of the pressure inside the first valve control chamber on the time after opening of the outlet conduit, for differently embodied volumes of the first valve control chamber.

FIGS. 3 and 4 show how the stroke of the valve control piston and the pressure gradient between the first and second valve control chambers can be varied by varying the volume in the first valve control chamber. Solid lines represent a smaller volume of the first valve control chamber, and dashed lines represent a larger volume of the first valve control chamber. The symbol VE stands for the range of the preinjection, and HE stands for the range of the main injection.

In the range HE, the lines come to be superimposed. It can be seen from FIG. 3 that the stroke of the valve control piston is shorter in the region VE if the volume of the first valve control chamber is larger. As FIG. 4 shows, the pressure inside the first valve control chamber drops more slowly, if there is a larger volume, to the level of the outlet conduit ($P_A$) after opening of the outlet throttle and then rises again to the level of the common rail ($P_{CR}$). Less fuel is preinjected. The main injection remains unchanged.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A valve control unit for a fuel injection valve having at least one injection opening controlled by a nozzle needle (4), comprising a housing body (2), in which first and second valve control chambers (8, 20; 9) that communicate continuously with one another are provided, the first valve control chamber (8; 20) communicates with an inflow conduit (10) for fuel, a terminal member (7; 21) of a valve control piston (3) is movably displaceable in the housing body (2) and positively connected to said nozzle needle, and the second valve control chamber (9) communicates with a closable outlet conduit (11), a mechanical stop that limits the mobility of the valve control piston (3) is embodied on the housing body (2) and thereby controls a stroke of the nozzle needle in a direction to the second valve control chamber (9).

2. The valve control unit according to claim 1, in which the valve control piston (3) changes over in steps from a larger to a smaller outer diameter, and a counterpart step (14) complementary to this step is present on the housing body (2).

3. The valve control unit according to claim 1, in which the first valve control chamber (8; 20) has a volume of up to 60 $mm^3$ which is substantially greater than the volume of the second valve control chamber (9).

4. The valve control unit according to claim 2, in which the first valve control chamber (8; 20) has a volume of up to 60 $mm^3$ which is substantially greater than the volume of the second valve control chamber (9).

5. A valve control unit for a fuel injection valve having at least one injection opening controlled by a nozzle needle, comprising a housing body (2), in which first and second valve control chambers (8, 20; 9) that communicate continuously with one another are provided, the first valve control chamber (8; 20) communicates with an inflow conduit (10) for fuel, a terminal member (21) of a valve control piston (3) which is movably displaceable in the housing body (2) is formed by a piston segment with a reduced outer diameter and the second valve control chamber (9) communicates with a closable outlet conduit (11), a mechanical stop that limits the mobility of the valve control piston (3) is embodied on the housing body (2) and thereby controls a stroke of the nozzle needle in a direction to the second valve control chamber (9), and that an adjusting ring (23) is disposed on an outer circumferential surface of the piston segment.

* * * * *